US009217277B2

(12) United States Patent
Hans

(10) Patent No.: US 9,217,277 B2
(45) Date of Patent: Dec. 22, 2015

(54) DOOR DRAINAGE SYSTEM

(75) Inventor: Eric David Hans, Mission Viejo, CA (US)

(73) Assignee: John B. Higman and Valorie J. Higman, Brea, CA (US), trustees of the Higman Family Trust u/d/t as amended and restated on Dec. 22, 2006

( * ) Notice: Subject to any disclaimer, the term of this patent is extended or adjusted under 35 U.S.C. 154(b) by 0 days.

(21) Appl. No.: 13/881,220

(22) PCT Filed: Oct. 24, 2011

(86) PCT No.: PCT/US2011/057534

§ 371 (c)(1),
(2), (4) Date: Apr. 24, 2013

(87) PCT Pub. No.: WO2012/061079

PCT Pub. Date: May 10, 2012

(65) Prior Publication Data

US 2013/0219817 A1 Aug. 29, 2013

Related U.S. Application Data

(60) Provisional application No. 61/406,532, filed on Oct. 25, 2010.

(51) Int. Cl.

| | |
|---|---|
| ***E04D 13/00*** | (2006.01) |
| ***E04D 15/00*** | (2006.01) |
| ***E04B 1/70*** | (2006.01) |
| ***E04C 2/38*** | (2006.01) |
| ***E06B 7/14*** | (2006.01) |
| ***E05D 15/06*** | (2006.01) |
| *E06B 7/26* | (2006.01) |
| *E06B 1/70* | (2006.01) |

(Continued)

(52) U.S. Cl.

CPC . *E06B 7/14* (2013.01); *E05D 15/06* (2013.01); *E06B 1/70* (2013.01); *E06B 3/4636* (2013.01); *E06B 7/2316* (2013.01); *E06B 7/26* (2013.01)

(58) Field of Classification Search

CPC ..... E06B 1/70; E06B 7/14; E06B 7/2316; E06B 3/9632; E06B 7/26; E06B 3/4636

USPC ..... 52/14, 15, 97, 102, 209, 302.1–302.3, 52/302.6, 393, 716.1–716.4, 716.8, 52/718.01–718.06

See application file for complete search history.

(56) References Cited

U.S. PATENT DOCUMENTS

| | | | |
|---|---|---|---|
| 2,248,719 | A | 7/1941 | Owen |
| 2,766,860 | A | 10/1956 | Travis |
| 2,971,228 | A | 2/1961 | Szabo |

(Continued)

*Primary Examiner* — Phi A
*Assistant Examiner* — Omar Hijaz
(74) *Attorney, Agent, or Firm* — Knobbe, Martens, Olson & Bear, LLP

(57) ABSTRACT

A drainage system is configured for draining water or other liquid intrusion in to building structure openings, access routes, including fenestration, door or window products. Embodiments include adjustable height drainage systems that are vertically adjustable to controllably place the height of the drainage system above, below or flush with one or more surrounding floor or fenestration portal surfaces. One or more adjustable members controllably move and position the cover with respect to the drainage system body. Drainage systems are readily accessible for service and/or adjustment of the drainage system without removal or disassembly of a fenestration product.

20 Claims, 15 Drawing Sheets

(51) Int. Cl.
*E06B 3/46* (2006.01)
*E06B 7/23* (2006.01)

(56) References Cited

U.S. PATENT DOCUMENTS

| | | | | | |
|---|---|---|---|---|---|
| 3,072,975 | A | | 1/1963 | Burmeister | |
| 3,225,393 | A | | 12/1965 | Coller | |
| 3,266,275 | A | | 8/1966 | Atkinson | |
| 3,295,257 | A | | 1/1967 | Jackson | |
| 3,374,579 | A | * | 3/1968 | Neff | 49/468 |
| 3,400,504 | A | | 9/1968 | Neisewander | |
| 3,660,936 | A | | 5/1972 | Bryson | |
| 3,743,336 | A | | 7/1973 | Andrews | |
| 3,993,338 | A | | 11/1976 | Cherbourg et al. | |
| 3,993,339 | A | | 11/1976 | Cherbourg et al. | |
| 4,074,464 | A | * | 2/1978 | McCay | 49/468 |
| 4,134,281 | A | | 1/1979 | Pelcin | |
| 4,372,084 | A | | 2/1983 | Janke | |
| 4,387,535 | A | * | 6/1983 | Corbo | 49/468 |
| 4,454,690 | A | | 6/1984 | Dixon | |
| 4,562,667 | A | | 1/1986 | Von Resch | |
| 4,611,436 | A | | 9/1986 | Williams | |
| 4,644,690 | A | | 2/1987 | Caimi | |
| 4,656,779 | A | | 4/1987 | Fedeli | |
| 4,688,352 | A | | 8/1987 | Kinoshita | |
| 4,805,345 | A | | 2/1989 | Ohi | |
| 4,895,403 | A | | 1/1990 | Osenkowski | |
| 5,067,279 | A | * | 11/1991 | Hagemeyer | 49/471 |
| 5,115,596 | A | | 5/1992 | Fevold et al. | |
| 5,136,814 | A | | 8/1992 | Headrick | |
| 5,179,804 | A | * | 1/1993 | Young | 49/471 |
| 5,301,468 | A | | 4/1994 | Kamezaki | |
| 5,339,881 | A | | 8/1994 | Owens | |
| 2,698,456 | A | | 1/1995 | Duvall | |
| 5,465,462 | A | | 11/1995 | Yamada | |
| 5,467,559 | A | | 11/1995 | Owens | |
| 5,471,791 | A | | 12/1995 | Keller | |
| 5,481,834 | A | | 1/1996 | Kowalczyk et al. | |
| 5,556,145 | A | | 9/1996 | Takasaki | |
| 5,581,949 | A | * | 12/1996 | Wu | 49/467 |
| 5,588,266 | A | * | 12/1996 | Headrick | 52/204.1 |
| 5,706,607 | A | * | 1/1998 | Frey | 49/478.1 |
| 5,887,387 | A | | 3/1999 | Dallaire | |
| 5,956,909 | A | * | 9/1999 | Chou | 52/209 |
| 6,062,614 | A | | 5/2000 | Petzold | |
| 6,082,047 | A | | 7/2000 | Comaglio et al. | |
| 6,185,870 | B1 | * | 2/2001 | Mettler | 49/468 |
| D465,398 | S | | 11/2002 | Linares et al. | |
| 6,484,446 | B2 | * | 11/2002 | Young | 49/469 |
| 6,497,072 | B2 | | 12/2002 | Fries | |
| 6,581,332 | B1 | | 6/2003 | Kim | |
| 6,792,651 | B2 | | 9/2004 | Weiland et al. | |
| 6,871,448 | B1 | | 3/2005 | Kline | |
| 6,904,869 | B1 | | 6/2005 | Geisthardt | |
| 6,938,375 | B2 | | 9/2005 | Duncan et al. | |
| 7,007,343 | B2 | * | 3/2006 | Weiland et al. | 16/96 R |
| 7,013,687 | B2 | | 3/2006 | Shedd et al. | |
| 7,124,538 | B1 | | 10/2006 | Kline | |
| 7,389,611 | B2 | * | 6/2008 | Palenske CI | 49/468 |
| 7,472,516 | B2 | * | 1/2009 | Pepper et al. | 49/468 |
| 7,552,954 | B2 | | 6/2009 | Rozo et al. | |
| 7,600,796 | B2 | | 10/2009 | Liang et al. | |
| 7,627,987 | B2 | | 12/2009 | Thielmann et al. | |
| 7,685,774 | B2 | | 3/2010 | Thielmann | |
| 7,685,775 | B2 | | 3/2010 | Speyer et al. | |
| 7,685,776 | B2 | | 3/2010 | Speyer et al. | |
| 8,033,068 | B2 | | 10/2011 | Luttmann et al. | |
| 8,109,037 | B2 | | 2/2012 | Speyer et al. | |
| 8,381,445 | B2 | | 2/2013 | Hans | |
| 2004/0003556 | A1 | | 1/2004 | Zerbst | |
| 2004/0200153 | A1 | * | 10/2004 | Khanlarian | 49/468 |
| 2005/0284027 | A1 | | 12/2005 | Duncan et al. | |
| 2006/0174545 | A1 | * | 8/2006 | Young | 49/468 |
| 2007/0051048 | A1 | | 3/2007 | Krohn et al. | |
| 2008/0209827 | A1 | | 9/2008 | Webb | |
| 2009/0077895 | A1 | | 3/2009 | Tshai | |
| 2009/0079207 | A1 | | 3/2009 | Manzhura et al. | |
| 2010/0013247 | A1 | | 1/2010 | Kuchas | |
| 2010/0300001 | A1 | * | 12/2010 | Wernlund et al. | 49/471 |
| 2011/0107674 | A1 | | 5/2011 | Sauter | |
| 2011/0126471 | A1 | | 6/2011 | Hans | |
| 2012/0291359 | A1 | | 11/2012 | Hans et al. | |
| 2013/0160369 | A1 | | 6/2013 | Hans | |
| 2013/0219817 | A1 | | 8/2013 | Hans | |

* cited by examiner

DOOR DRAINAGE SYSTEM

CROSS-REFERENCE TO RELATED APPLICATIONS

This application is a U.S. National Phase under 35 U.S.C. §371 of International Application No. PCT/US2011/057534, filed on Oct. 24, 2011 and published in English on Ma 10, 2012, which claims the benefit of priority to U.S. Provisional Application No. 61/406,532, filed Oct. 25, 2010, which is incorporated by reference in its entirety herein. Any and all priority claims identified in the Application Data Sheet, or any correction thereto, are hereby incorporated by reference under 37 CFR 1.57.

BACKGROUND

1. Field

Embodiments of the present invention generally relate to systems and methods for drainage of door, window and other fenestration systems, and more specifically relate to accessible adjustable height drainage systems configured for draining water or other liquid intrusion in to building structure openings, access routes, or fenestration products such as one or more doors, sliding doors, hinged doors, rotational door, revolving doors, jambs, windows, window sills, and other types of openings in a building or wall.

2. Description of the Related Art

Various door, window and fenestration systems have long been a desirable option for providing access to residences, businesses and other structures as they can provide an opening for entry and exit. However, with environmental conditions, water, rain, snow, sprinklers, flooding, puddles or other liquids can also enter from the exterior to the interior of a structure through these systems, potentially causing cosmetic or structural damage to flooring, rugs, carpets, paneling, furniture, and other items inside the structure. Some drainage systems are fixed or non-adjustable, and some require removal of the door or window for accessibility for service, adjustment or cleaning purposes.

Some door, window or fenestration systems are difficult to seal. Some door systems include some type of weather stripping or a brush along a border or edge to form a seal with the floor, wall, and/or ceiling surface. However, in order to effectively seal, some types of weather stripping or brushes slide along the floor or other surface while the door system is being opened or closed. Accordingly, the weather stripping can wear rather quickly until it loses effectiveness at forming a seal. If the unit is adjusted downward in order to close the gap too much, the added friction will not allow the panel to slide freely. Many attempts to just add brushes to reduce the friction will allow water and air infiltration. Thus, many of these systems do not easily compensate for infiltration of non-desired liquids in to the interior of a structure.

SUMMARY

Several embodiments of the present invention relate to drainage systems for reduction or elimination of liquid infiltration in to a structure though an access point in or out of buildings or structures, such as commercial or residential homes, or other structures with doors or windows. In some embodiments, the drainage system is adjustable. In some embodiments, the drainage system is vertically adjustable to controllably place the height of the drainage system above, below or flush with one or more surrounding floor or fenestration portal surfaces. In some embodiments, the drainage system is readily accessible for service without removing or disassembling the door or window.

In various embodiments, the drainage system can be used with any door or window or other opening in a wall for any type of structure, such as a door, sliding door, hinged door, revolving door, rotating door, pet door, window or other portal structure. Although some embodiments will be described in the context of use on a sliding door system, some embodiments of the drainage system can be used on any type of door, window, or panel.

In various embodiments, a drainage system is configured to redirect water or other liquids or fluids from accumulation on or near a door or other structural entry point. In various embodiments, the drainage system includes a channel to collect liquid and redirect or drain the liquid to the exterior or to a drainage system, such as a sewer or rain gutter or other system for removing the liquid from the structure. In one embodiment, the drainage system includes an adjustable dimension component for vertically, horizontally, or otherwise moveably adjusting a drainage system component, such as a cap, to a position with respect to the surrounding floor, wall, or other structural feature. In various embodiments, the drainage system is accessible for service. In various embodiments the service is cleaning, adjusting, adjusting the height, or other action in relation to the drainage system.

In one embodiment, a door drainage system includes a base, an adjustable height cover and two or more adjustable members configured to controllably position the adjustable height cover. The base includes a channel configured for redirecting a liquid away from a door. The adjustable height cover is removably positionable on the base. In one embodiment, the adjustable height cover is configured to be readily removable from the base for service without removing or disassembling the door. In one embodiment, the adjustable member base is connected to the base. In one embodiment, the adjustable member is linearly positionable with respect to the adjustable member base. In various embodiments, the two or more adjustable members are configured to controllably position the adjustable height cover to be flush with, higher than, or recessed below an adjacent structural surface. In one embodiment, at least one adjustable member includes an elongate threaded member configured for controlled vertical positioning of the adjustable height cover. In one embodiment, the adjustable height cover includes a plurality of apertures configured to redirect flow of a liquid through the drainage system. In one embodiment, the body includes a first wall, a second wall and a base at least partially surrounding the channel. In one embodiment, the body includes a U-shaped extrusion. In one embodiment, the door drainage system also includes a filter configured to fit in the channel. In one embodiment, the drainage system also includes one or more exit ports in the base in fluid connection with one or more drainage ports configured to direct the liquid away from the base. In one embodiment, the drainage system also includes a valve for adjustable fluid control. In one embodiment, a valve is disposed on one or more drainage ports. In one embodiment, the drainage system also includes one or more sliding doors disposed on a track disposed in an exterior position with respect to the base.

1. In one embodiment, a door drainage system includes a base, an adjustable height cover, an adjustable member base, two or more adjustable members, and one or more exit ports. The base includes a channel configured for redirecting a liquid away from a door. The adjustable height cover is removably positionable on the base, with the adjustable height cover including a plurality of apertures configured to redirect flow of a liquid through the drainage system. The adjustable member base is connected to the base, and the adjustable member is linearly positionable with respect to the adjustable member base. The two or more adjustable members are configured to controllably position the adjustable height cover to be flush with, higher than, or recessed below an adjacent structural surface. The one or more exit ports in the base is in fluid connection with one or more drainage ports configured to direct the liquid away from the base. The adjustable height cover is configured to be readily removable from the base for service without removing or disassembling the door. In one embodiment, at least one adjustable member includes an elongate threaded member configured for controlled vertical positioning of the adjustable height cover. In one embodiment, the drainage system includes a filter configured to fit in the channel. In one embodiment, the drainage system includes a valve for adjustable fluid control.

In one embodiment, a fenestration product drainage system includes a base, an adjustable height cover, and an adjustable member. The base includes a channel configured for redirecting a liquid away from a fenestration product. The adjustable height cover is removably positionable on the base. The adjustable member is configured to controllably position the adjustable height cover. In one embodiment, the adjustable height cover is configured to be readily removable from the base for service without removing or disassembling the fenestration product. In one embodiment, the fenestration product is a door. In one embodiment, the fenestration product is a window. In one embodiment, the adjustable member includes an elongate threaded member configured for controlled vertical positioning of the adjustable height cover. In one embodiment, the fenestration product includes one or more exit ports in the base in fluid connection with one or more drainage ports configured to direct the liquid away from the base. In one embodiment, the fenestration product includes a valve for adjustable fluid control. In one embodiment, the fenestration product includes a filter configured to fit in said channel.

The details of various embodiments are set forth in the accompanying drawings and the description herein. Other features and advantages will be apparent from the description and drawings, and from the claims.

BRIEF DESCRIPTION OF THE DRAWINGS

These and other aspects of embodiments of the present invention will now be described in detail with reference to the following drawings.

Figure 1:
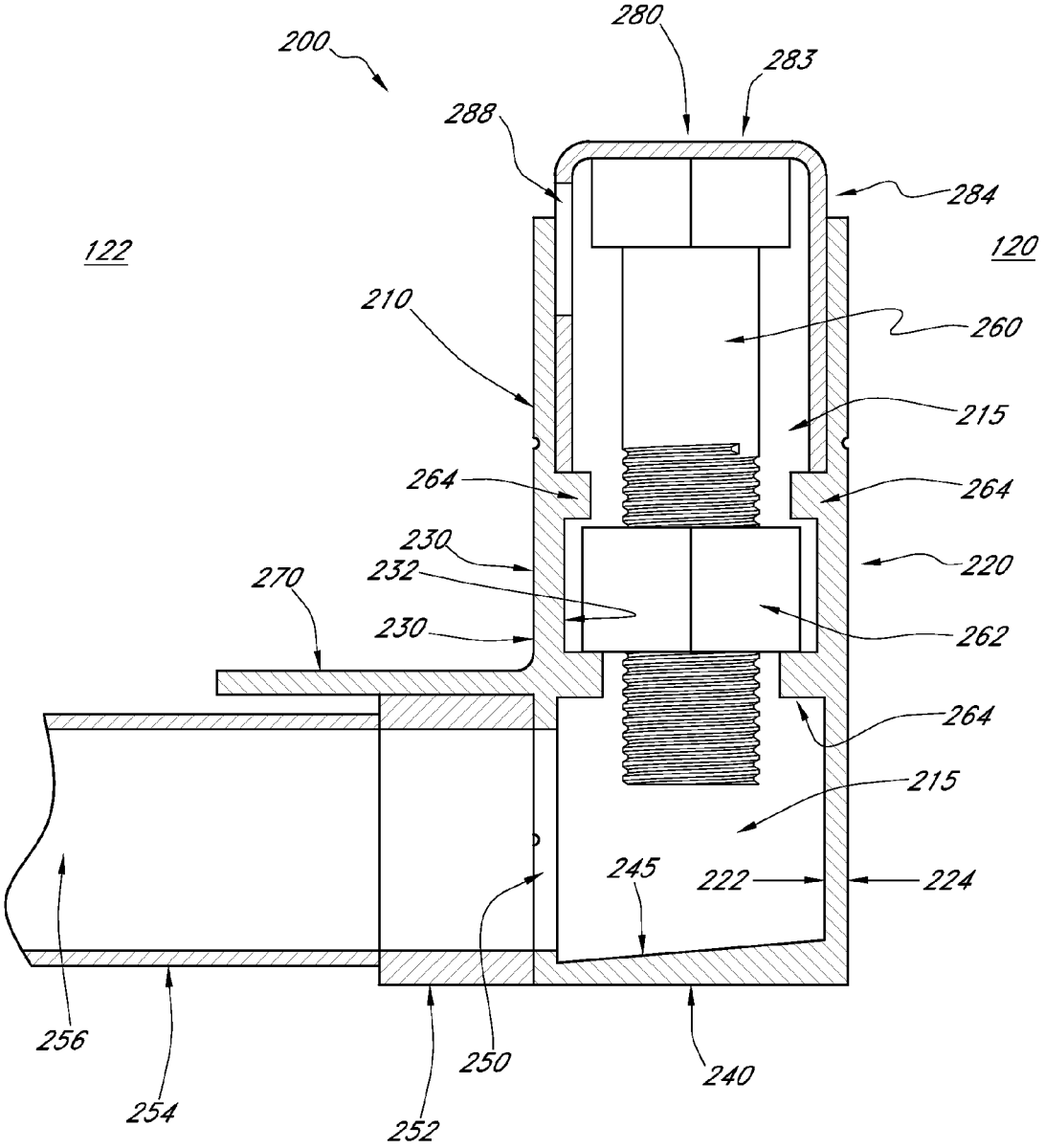
FIG. 1 is a schematic front partial cross sectional view of a drainage system according to an embodiment of the present invention.

Like reference symbols in the various drawings indicate like elements. Throughout the figures, the same reference numerals and characters, unless otherwise stated, are used to denote like features, elements, components or portions of the illustrated embodiments. Moreover, while embodiments of the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION

Several embodiments of the present invention relate to drainage systems for access points to architectural building structures, such as commercial or residential homes, buildings, or other structures with doors or windows. In various embodiments, the drainage system can be used with any door or window or other opening in a wall for any type of structure, such as a door, sliding door, hinged door, rotatable door, revolving door, pet door, or window. Although some embodiments will be described in the context of use on a sliding door system, some embodiments of the drainage system can be used on any type of door, window, or panel. In various embodiments, the drainage system can be configured to be flush with, higher than, or recessed below a floor or jamb surface. In some embodiments, the drainage system is located inside, outside, or anywhere on the floor between interior to exterior jamb edges. In various embodiments, the drainage system can be configured to act as a stop on the interior or exterior of any door, window, or other fenestration product. In one embodiment, the drain system is configured to prevent liquid or moisture from entering the interior of a structure beyond an interior jamb line.

FIG. 1 illustrates one embodiment of the invention in which a drainage system 200 is configured to reduce or eliminate liquid infiltration in to a structure through a fenestration product 10. In various embodiments, the fenestration product is a door, window, or other moveable closure device configured for providing access in to or out of a structure, building or wall. In various embodiments, the drainage system 200 comprises a body 210 and a cover 280. In one embodiment, the body 210 is a U-shaped extrusion with a first wall 220, a second wall 230 and a base 240 partially or completely surrounding a channel 215. In one embodiment, the first wall 220 comprises a first wall channel surface 222 facing the channel 215 and a first wall floor surface 224 facing a floor 6, 7 or a direction laterally outside of the body 210. In one embodiment, the second wall 230 comprises a second wall channel surface 232 facing the channel 215 and a second wall floor surface 234 facing a floor 6, 7 or a direction laterally outside of the body 210. In one embodiment, the first wall 220 has a first wall height 226 (see FIGS. 7 and 8). In one embodiment, the second wall 230 has a second wall height 236. In various embodiments, the first wall height 226 is the same or similar to the second wall height 236, the first wall height 226 is greater than the second wall height 236, or the first wall height 226 is less than the second wall height 236. In various embodiments, the first wall height 226 and/or the second wall height 236 is less than 1 inch, 1 inch, 1.125 inches, 1.1875, 1.25 inches, 1.375 inches, 1.5 inches, 1.625 inches, 1.75 inches, 1.875 inches, 2 inches, 2.125 inches, 2.1875, 2.25 inches, 2.375 inches, 2.5 inches, 2.625 inches, 2.75 inches, 2.875 inches, 3 inches, 3.125 inches, 3.1875, 3.25 inches, 3.375 inches, 3.5 inches, 3.625 inches, 3.75 inches, 3.875 inches, 4 inches, or any dimension or range of dimensions between 0.5 inches and 1 foot or more.

In one embodiment, the first wall 220 is on an interior 120 side and the second wall 230 is on an exterior 122 side of the drainage system 200 with respect to a fenestration product 10. In one embodiment, the first wall 220 is on an exterior 122 side and the second wall 230 is on an interior 120 side of the drainage system 200 with respect to a fenestration product 10.

In one embodiment, the base 240 includes a base channel surface 245 facing the channel 215. In various embodiments, the base channel surface 245 is sloped, slanted, angled, or configured to direct a liquid from the channel 215 to one, two, three, four, or more exit ports 250. In various embodiments, the second wall 230 includes one, two, three, four, or more exit ports 250. In various embodiments, the first wall 220 includes one, two, three, four, or more exit ports 250. In various embodiments, the base channel surface 245 includes one, two, three, four, or more exit ports 250.

In one embodiment, the exit port 250 is in fluid connection with one or more drainage ports 254. In one embodiment, the drainage port 254 includes a drainage port lumen 256 configured to direct a liquid away from the channel 215 of the base 210. In various embodiments, the drainage port 254 is directed toward the exterior 122 of the structure, the interior of the structure 120, a sewer, a gutter, a rain gutter, piping, tubing, or other devices for diverting a fluid away from a structure.

Figure 11:
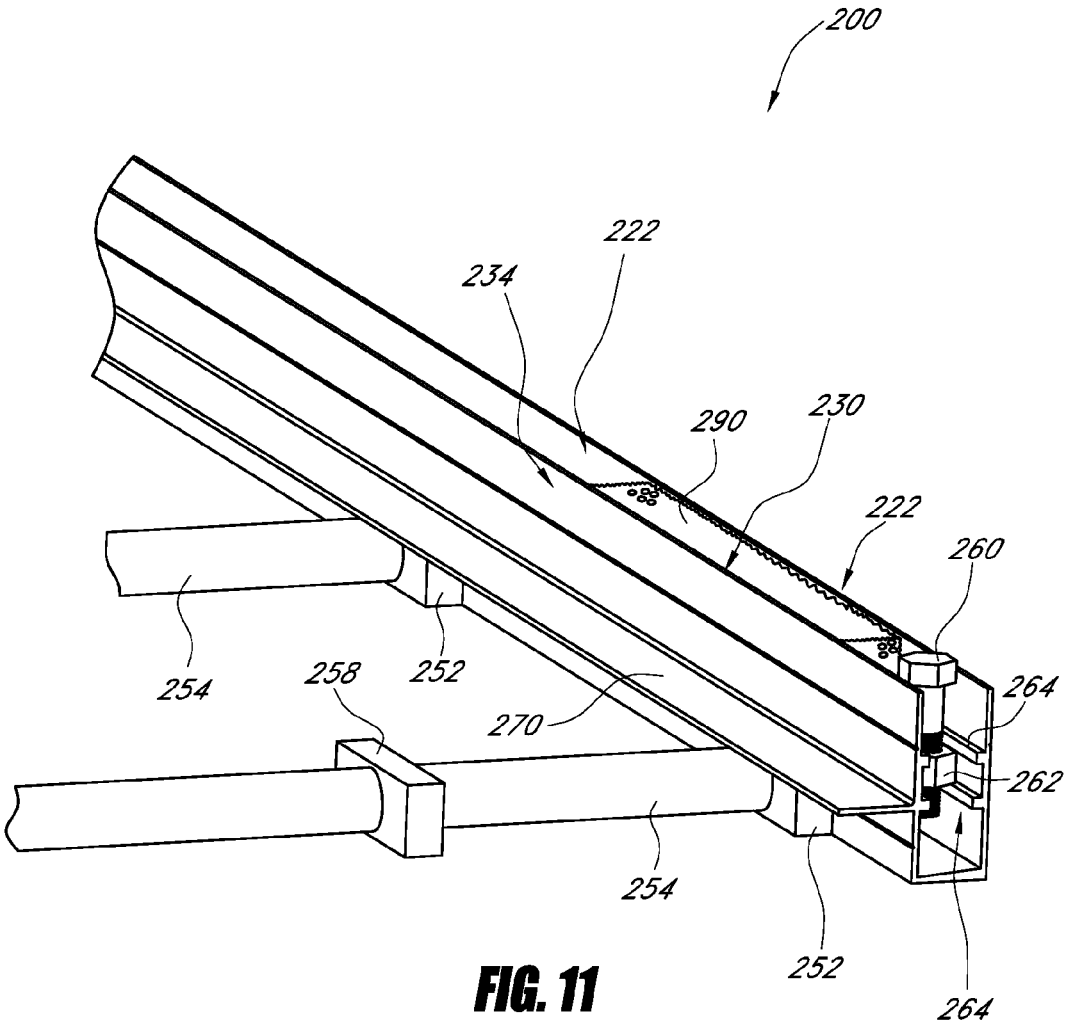
FIG. 11 is a schematic isometric view of the drainage system according to FIG. 7 with an adjustable height cover removed.
Figure 12:
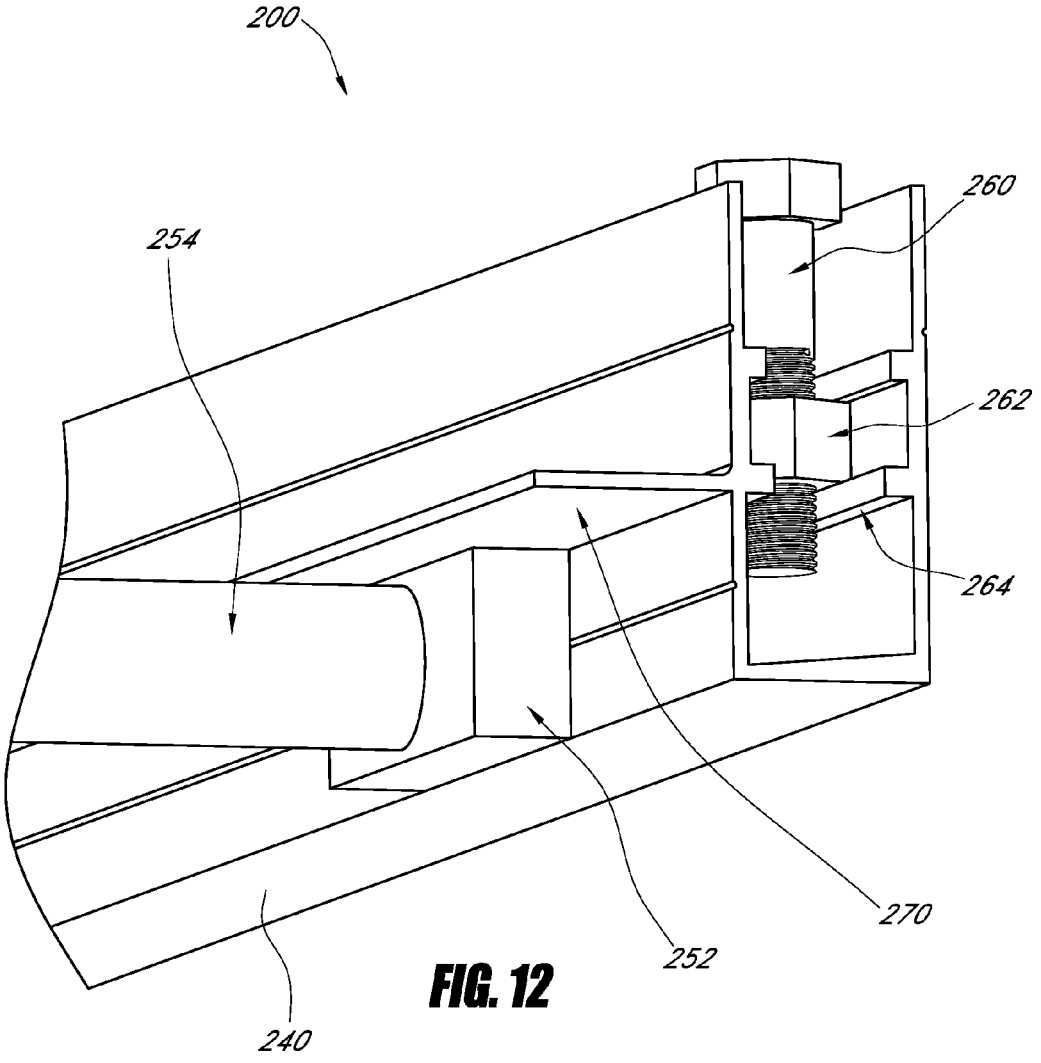
FIG. 12 is a schematic elevated isometric view of the drainage system according to FIG. 7 with an adjustable height cover removed.
Figure 13:
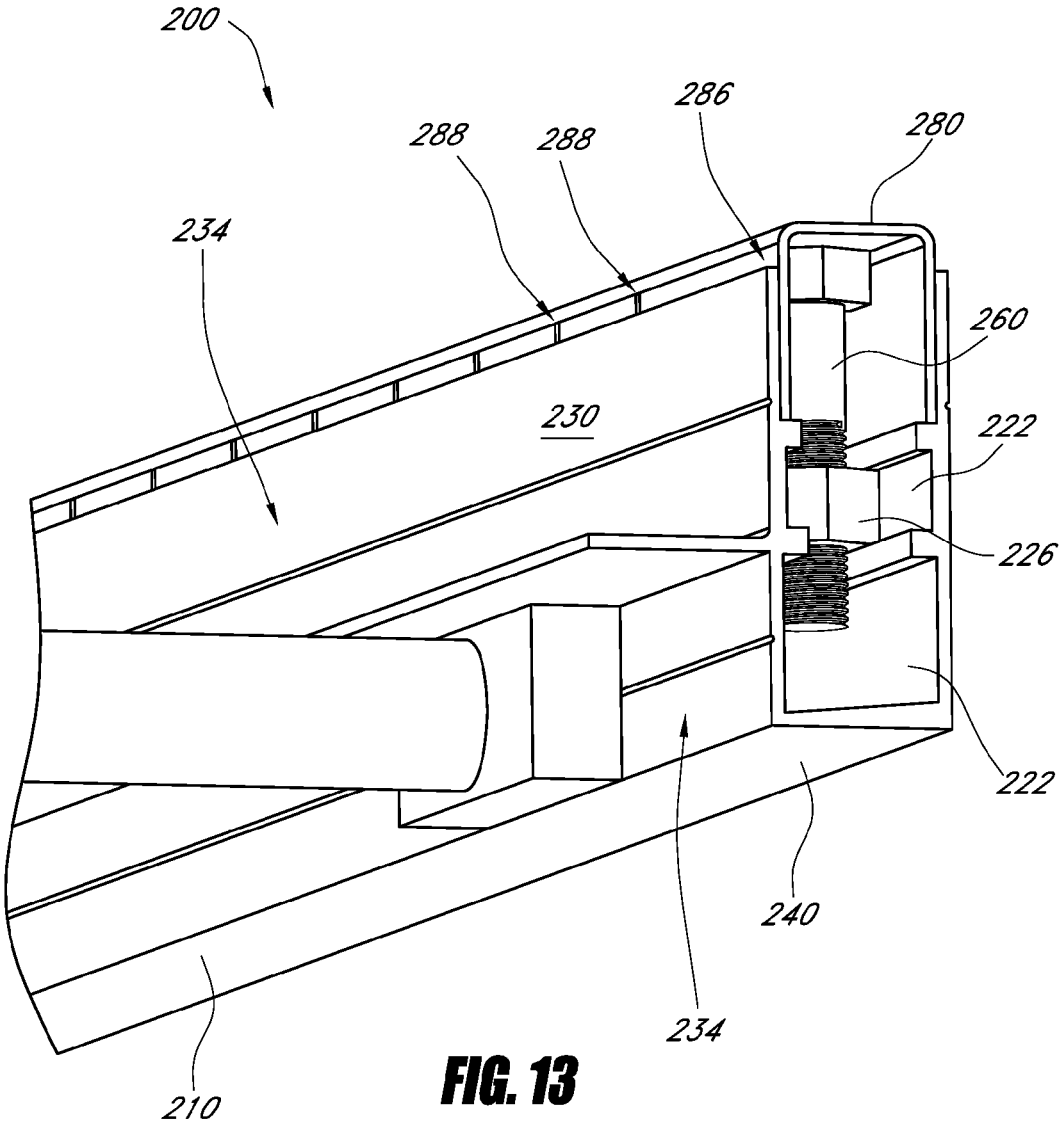
FIG. 13 is a schematic elevated isometric view of the drainage system according to FIG. 7.
Figure 14:
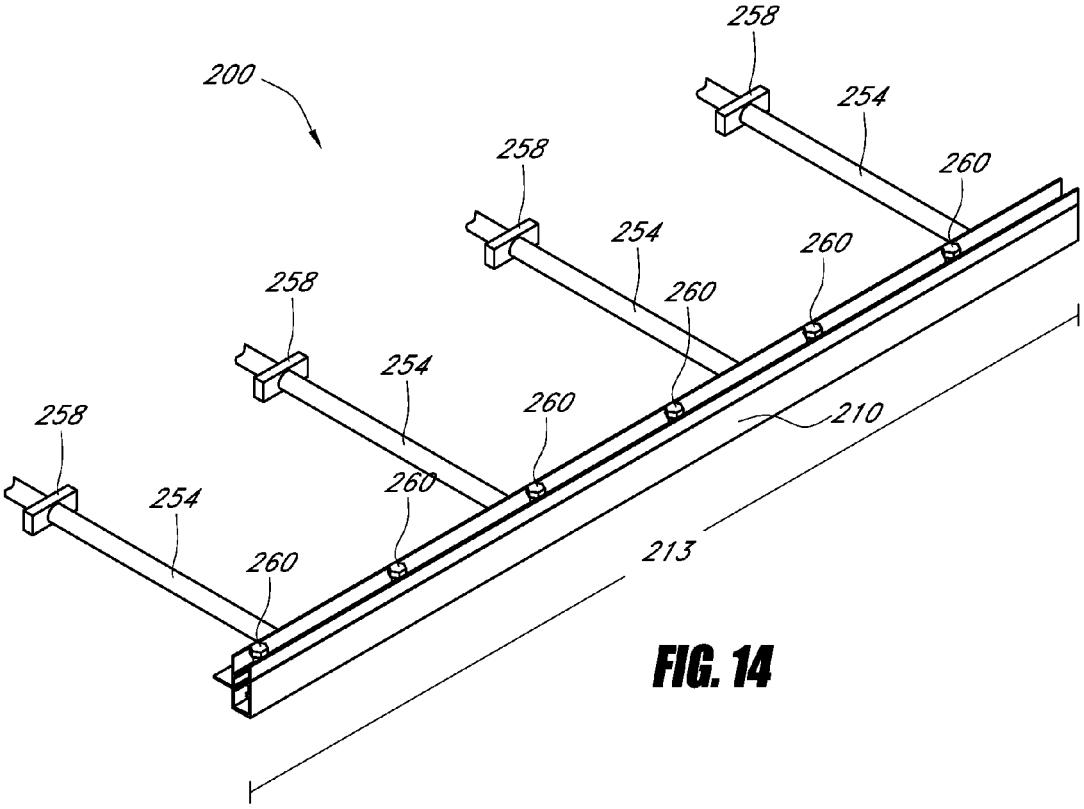
FIG. 14 is a schematic side isometric view of the drainage system according to FIG. 7.
Figure 15:
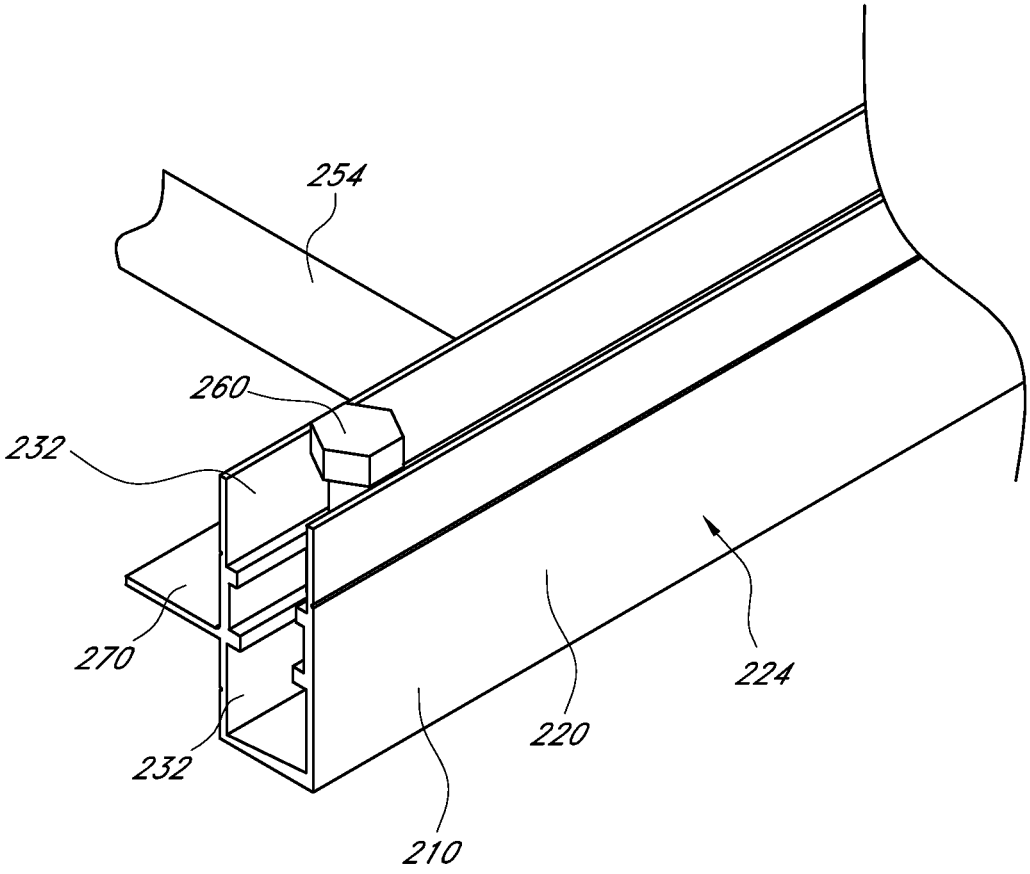
FIG. 15 is a schematic side isometric view of the drainage system according to FIG. 7 with an adjustable height cover removed.
Figure 16:
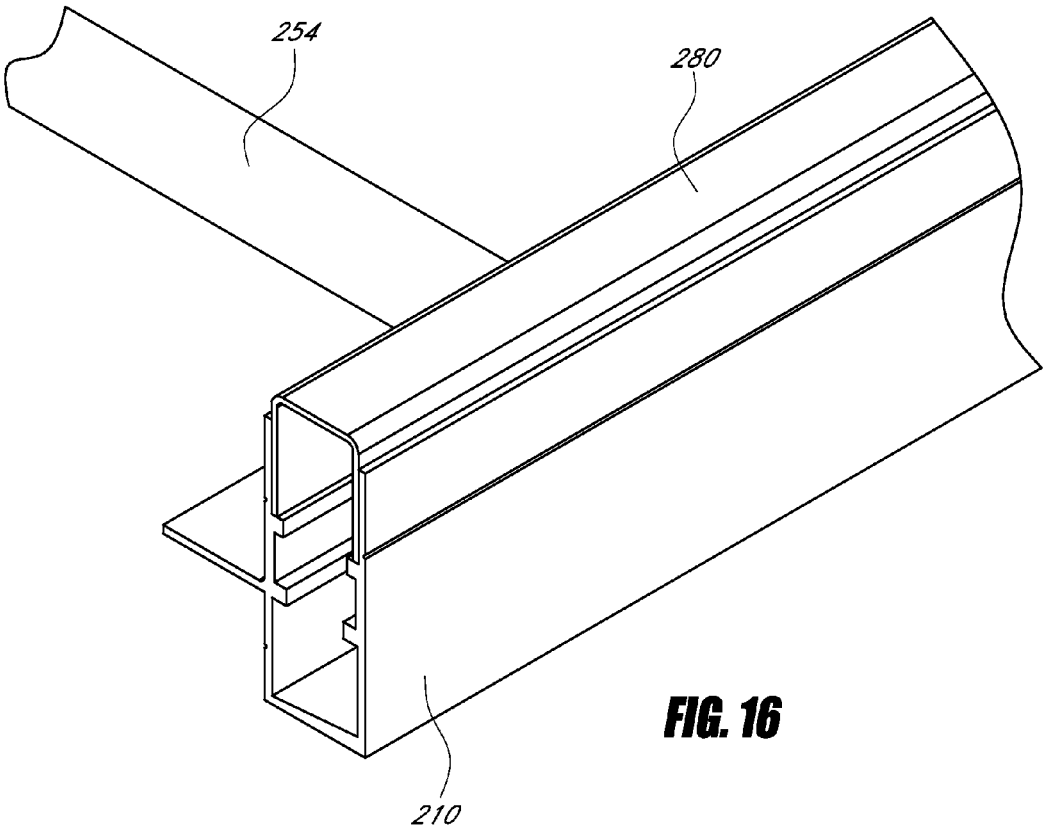
FIG. 16 is a schematic side isometric view of the drainage system according to FIG. 7 with an adjustable height cover removed.

In various embodiments, a valve 258 may be placed in or along the fluid drainage route. In one embodiment, one or more valves 258 are positioned to control the rate and/or direction of fluid (gas, liquid, etc.) flow. In one embodiment, one or more valves 258 is positioned in or along one or more exit ports 250. In one embodiment, as shown in FIGS. 11 and 14, one or more valves 258 is positioned in or along one or more drainage ports 254. In one embodiment, one or more valves 258 is positioned in or along one or more drainage port lumens 256. In one embodiment, one or more valves 258 is positioned in or along a structure, interior structure, exterior structure, drain, sewer, a gutter, a rain gutter, piping, tubing, or other devices for diverting a fluid away from a structure. In some embodiments, one or more valves 258 is readily accessible for service or actuation without removing or disassembling the door or window. In various embodiments, the valve 258 can be accessed through removal of the cover 280. In various embodiments, a valve 258 can be directly or indirectly controlled through manual manipulation, electronic control, remote control, and other techniques. In one embodiment, a valve 258 can be altered or actuated to account for potential severe weather conditions, such as a storm, flooding, rain, high winds or other conditions. In various embodiments, a valve 258 can open, close, partially obstruct, and/or redirect flow within the drainage system 200. In some embodiments, fluid flow moves in a direction from high to low pressure, and can use pressure or head to control fluid flow. In various embodiments, one or more actuators, handles, levers, pedals, switches, pistons, diaphragms, hydraulics, pneumatics, solenoids, motors, and/or materials can be used to respond to pressure, temperature, humidity or other measurable conditions. In various embodiments, a valve 258 may be a ball valve, butterfly valve, disc valve, check valve, one-way valve, two-way valve, choke valve, diaphragm valve, gate valve, globe valve, knife valve, needle valve, pinch valve, piston valve, plug valve, poppet valve, spool valve, thermal expansion valve, pressure relief valve, active valve, passive valve, or any other type of valve. In various embodiments, a valve 258 can connects to the drainage system 200 mechanically, chemically, magnetically, in threaded engagement, snap locked together, adhered, bonded, or with other connecting devices or methods.

In various embodiments, any components of a drainage system 200 can be manufactured from stainless steel, aluminum, metal, plastic, wood, hard wood or other materials and can be extruded, machines, cast, and/or completed with multiple finishes to accommodate specific needs of a customer whether for harsh weather conditions or more aesthetically pleasing to their tastes. In various embodiments, the drainage port 254 is rigid, flexible, malleable, bendable, PVC, copper, tubing, and can be circular, rectangular, square, or any other shape in cross section. In various embodiments, the drainage port 254 has a length in the range of 1-12 inches, 1-5 feet or more, the width of a door assembly, the width of a window assembly, the width of a jamb, configured to connect to a secondary drainage system, or other lengths. In one embodiment, the drainage port 254 is connectable to the base 210 with an exit port interface 252. In various embodiments, the exit port interface 252 connects the drainage port 254 to the base 210 mechanically, chemically, magnetically, in threaded engagement, snap locked together, adhered, bonded, or with other connecting devices or methods.

In various embodiments, the body 210 can optionally include one, two, three, four or more flanges 270. In various embodiments, the flanges 270 can structurally connect the body 210 to a fenestration product 10 or objects related to the fenestration product 10, an interior floor 6, an exterior floor 7, a track 8, channel, extrusion, or other structure. In various embodiments, the drainage system 200 is optionally configured to fit with or connect to a fenestration system, a door system, a window system, a track system, a cross member, flooring, interior flooring, exterior flooring, a shim, shim space, caulk, caulk line, seal, sill pan, flashing, insulation, stone, concrete, wood, foundation, framing, drywall, expansion joints, or other structures.

In one embodiment, a cover 280 is an adjustable cover. In one embodiment, the cover 280 is height-adjustable. In one embodiment, the cover 280 includes a cover top surface 283. In one embodiment, the cover 280 includes a cover top surface 283, a cover first wall 284 and a cover second wall 286. In one embodiment, the cover 280 is a U-shaped cap. In one embodiment, the cover 280 has a cover width 281 and a cover height 282 and a cover length 287 (see FIG. 18). In various embodiments, the cover 280 can be configured with a cover width 281 and a cover height 282 and a cover length 287 to fit on top of a base 210, inside a base 210, around a base 210, outside a base, have corresponding dimensions as a base 210, have a dimension that is greater than a corresponding base 210 dimension, have a dimension that is less than a corresponding base 210 dimension, have a dimension that is the same as or similar to a corresponding base 210 dimension, or other dimensions. In various embodiments, the cover length 287 is 1 foot or less, 1-5 feet, 5-10 feet, 10 feet or more, or any range of sizes. In various embodiments, a drainage system 200 is straight, curved, arced, segmented, angular, or otherwise shaped to meet fenestration product 10 dimensions.

Figure 17:
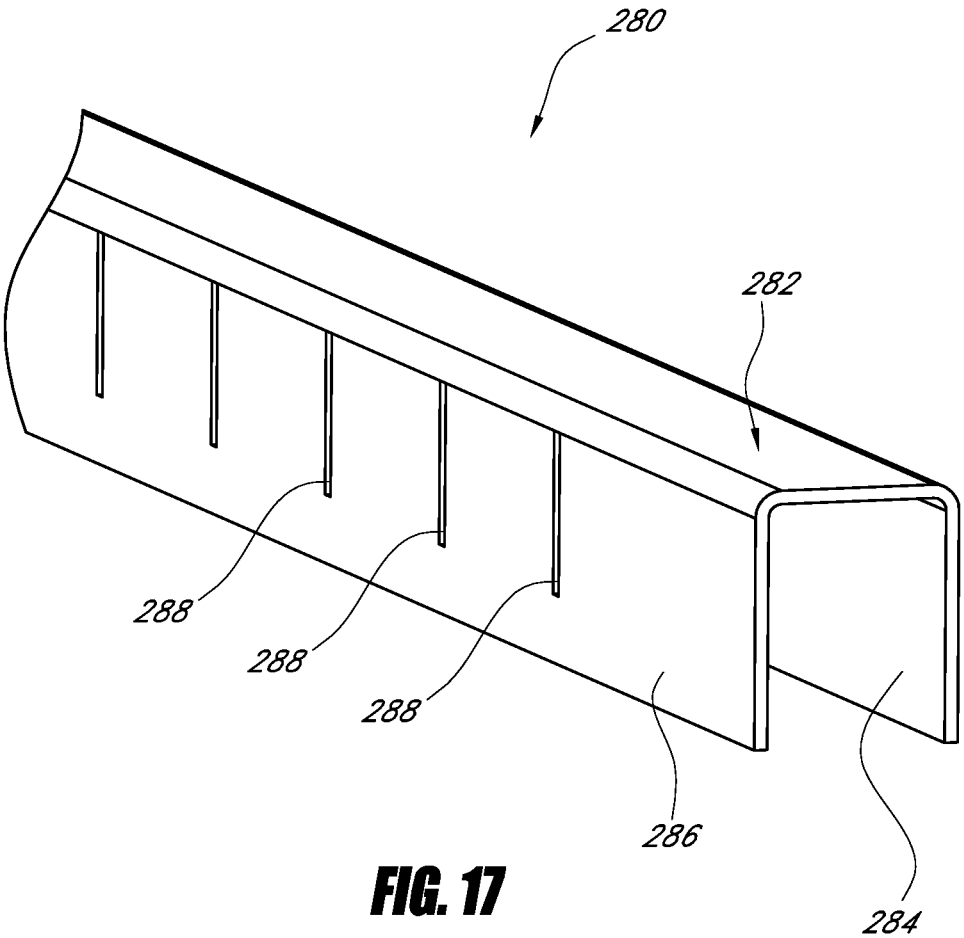
FIG. 17 is a schematic isometric view of a cover according to an embodiment of the present invention.
Figure 18:
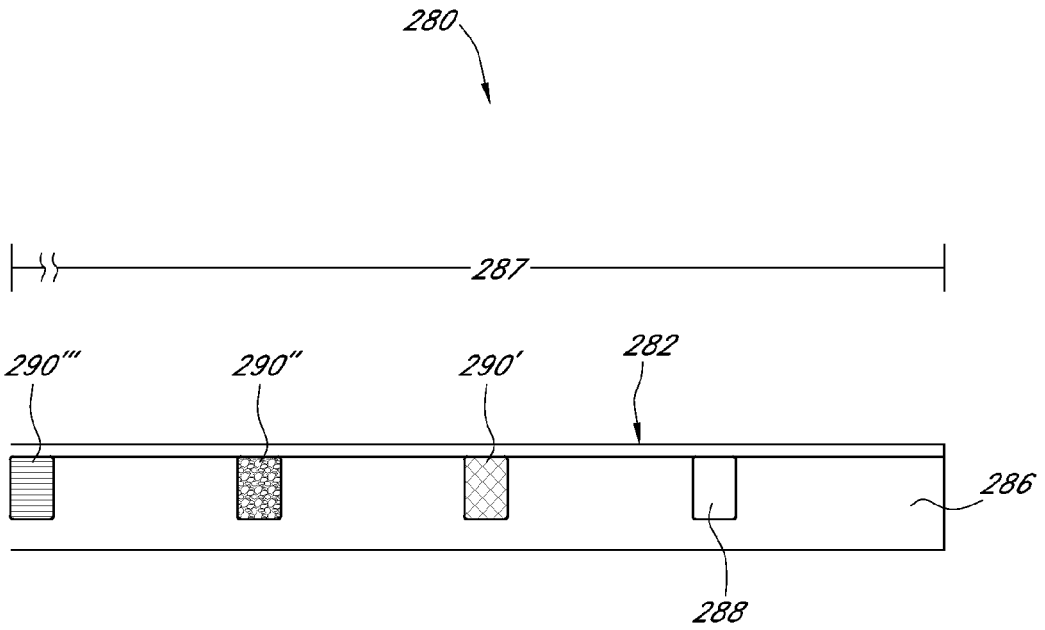
FIG. 18 is a schematic side view of a cover according to FIG. 17.

In one embodiment, the cover 280 includes one or more apertures 288. In various embodiments, the cover 280 includes one, two, three, four, five or more, ten or more, twenty or more, fifty or more, a plurality, or multiple apertures 288 configured to redirect fluid from the cover 280 through the channel 215 of the body 210 to one or more drainage ports 254. In various embodiments, the apertures 288 can be located on the cover top surface 283, the cover first wall 284 and/or the cover second wall 286. In one embodiment the cover has a cover width 281 (see FIGS. 7 and 8). In one embodiment the cover has a cover height 282 (see FIGS. 7 and 8). In one embodiment the distance of the top of the cover 280 to the top of a body wall 220, 230 is a cover-to-body-wall height 292 (see FIGS. 7 and 8). In various embodiments, the cover-to-body-wall height 292 is less than 1 inch, 0.125 inches, 0.1875, 0.25 inches, 0.375 inches, 0.5 inches, 0.625 inches, 0.75 inches, 0.875 inches, 1.0 inches, 1.25 inches, 1.5 inches, 2 inches, or any dimension or range of dimensions between 0.125 inches and 3 inches or more. FIGS. 17-18 illustrate a cover 280 according to an embodiment of the present invention.

In various embodiments, the one or more apertures 288 is a slot, opening, hole, weep hole, a punch hole, a filter, or otherwise configured to redirect flow of a liquid away from a fenestration product 10. In various embodiments, the one or more apertures 288 can have a circular, oval, rounded, rectilinear, square, rectangular, slanted, patterned or other shape. In one embodiment, the apertures 288 are configured to prevent the passage of insects or debris from clogging the drainage system 200. In one embodiment, the cover 280 is configured to be readily accessible for servicing without removing or disassembling the fenestration product 10.

In one embodiment, the drainage system 200 includes one or more adjustable members 260 configured to be movable with respect to an adjustable member base 262 to adjust a dimension or a position of the cover 280. In one embodiment, the one or more adjustable members 260 are configured to alter, modify, adjust, move, or align a cover 280. In one embodiment, an adjustable member 260 is configured to change the cover-to-body-wall height 292. In various embodiments, the adjustable member 260 is a screw, bolt, nut, spring, lever, mechanism, solenoid, ratchet, gear, shim, elongate member, threaded member, or other device configured to be controllably altered to change and/or maintain the position of an adjustable cover 280. In various embodiments, the adjustable member base 262 is a threaded hole, nut, screw, bolt, spring, lever, mechanism, solenoid, ratchet, gear, shim, elongate member, threaded member, or other device configured to be controllably change and/or maintain the position of the adjustable member 260. In one embodiment, the adjustable member 260 is configured to be readily accessible for servicing without removing or disassembling the fenestration product 10. In one embodiment, the adjustable member base 262 is configured to be readily accessible for servicing without removing or disassembling the fenestration product 10.

In one embodiment, the first wall channel surface 222 includes one, two, three, four, or more adjustable member interfaces 264. In one embodiment, an adjustable member interface 264 extends along a body length 213 of body 210 (see FIG. 14). In various embodiments, an adjustable member interface 264 is configured to connect the base 210 to an adjustable member 260 and/or an adjustable member base 262 through unitary construction, separate movable parts, welding, bonding, attaching, adhering, permanently attaching, temporarily attaching or some other type of interface. In one embodiment, the drainage system 200 is configured to conceal, contain, and/or route wires, connectors, cables, optical cables, lights, sensors, alarms or other apparatus in proximity to a fenestration product 10.

As illustrated in FIGS. 2-6, in accordance with various embodiments of drainage systems 200, one or more drainage systems 200 includes can be used with one or more fenestration products 10.

Figure 2:
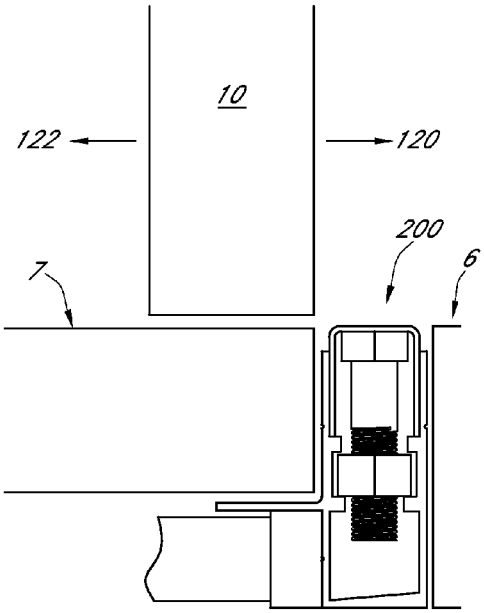
FIG. 2 is a schematic front partial cross sectional view of a flush configuration drainage system according to an embodiment of the present invention.

FIG. 2 illustrates a flush configuration drainage system 200 according to an embodiment of the present invention in which a cover 280 is configured to be substantially flush with an interior floor surface 6, an exterior floor surface 7, or both. In one embodiment, the cover 280 is an adjustable cover 280 set to a height to allow a fenestration product 10 to open or close inward and/or outward, in an interior 120 direction, an exterior 122 direction, and/or a direction parallel or substantially parallel to the body length 213 of the drainage system 200.

Figure 3:
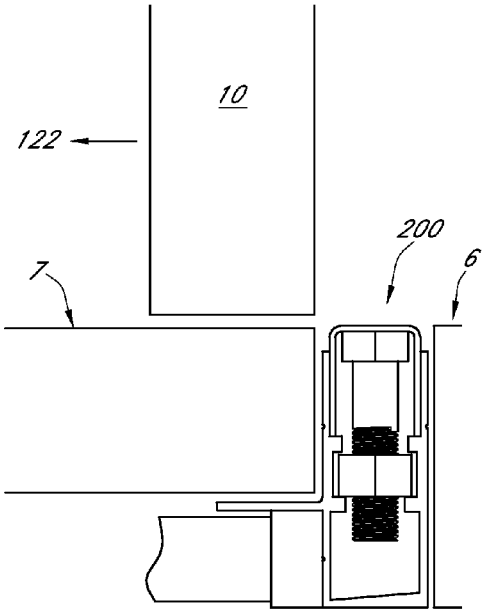
FIG. 3 is a schematic front partial cross sectional view of an elevated configuration drainage system according to an embodiment of the present invention.

FIG. 3 illustrates an elevated configuration drainage system 200 according to an embodiment of the present invention in which a cover 280 is configured to be elevated above an interior floor surface 6, an exterior floor surface 7, or both. In one embodiment, the cover 280 and/or body 210 of the drainage system 200 is configured to act as a stop to a fenestration product 10, preventing motion in the direction impacting or abutting the drainage system 200.

Figure 4:
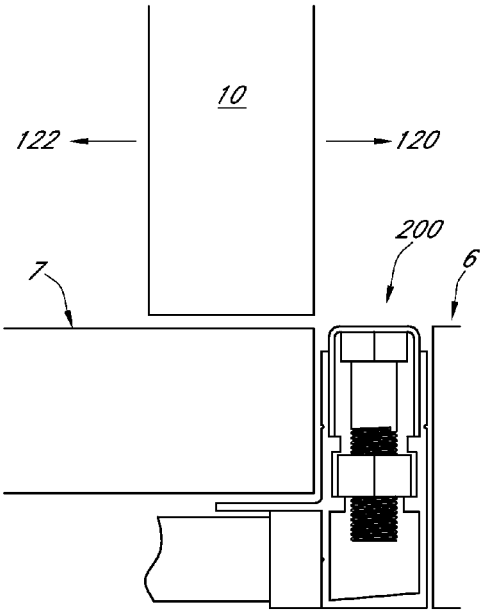
FIG. 4 is a schematic front partial cross sectional view of a recessed configuration drainage system according to an embodiment of the present invention.

FIG. 4 illustrates a recessed configuration drainage system 200 according to an embodiment of the present invention in which a cover 280 is configured to be recessed below an interior floor surface 6, an exterior floor surface 7, or both. In one embodiment, the cover 280 is an adjustable cover 280 set to a height to allow a fenestration product 10 to open or close inward and/or outward, in an interior 120 direction, an exterior 122 direction, and/or a direction parallel or substantially parallel to the body length 213 of the drainage system 200.

Figure 5:
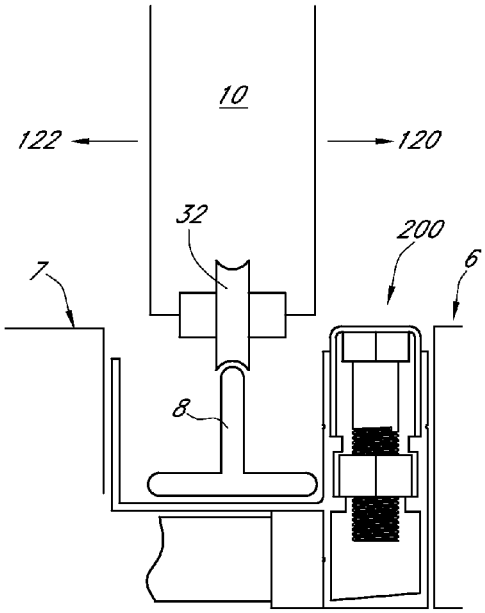
FIG. 5 is a schematic front partial cross sectional view of a sliding door configuration drainage system according to an embodiment of the present invention.
Figure 6:
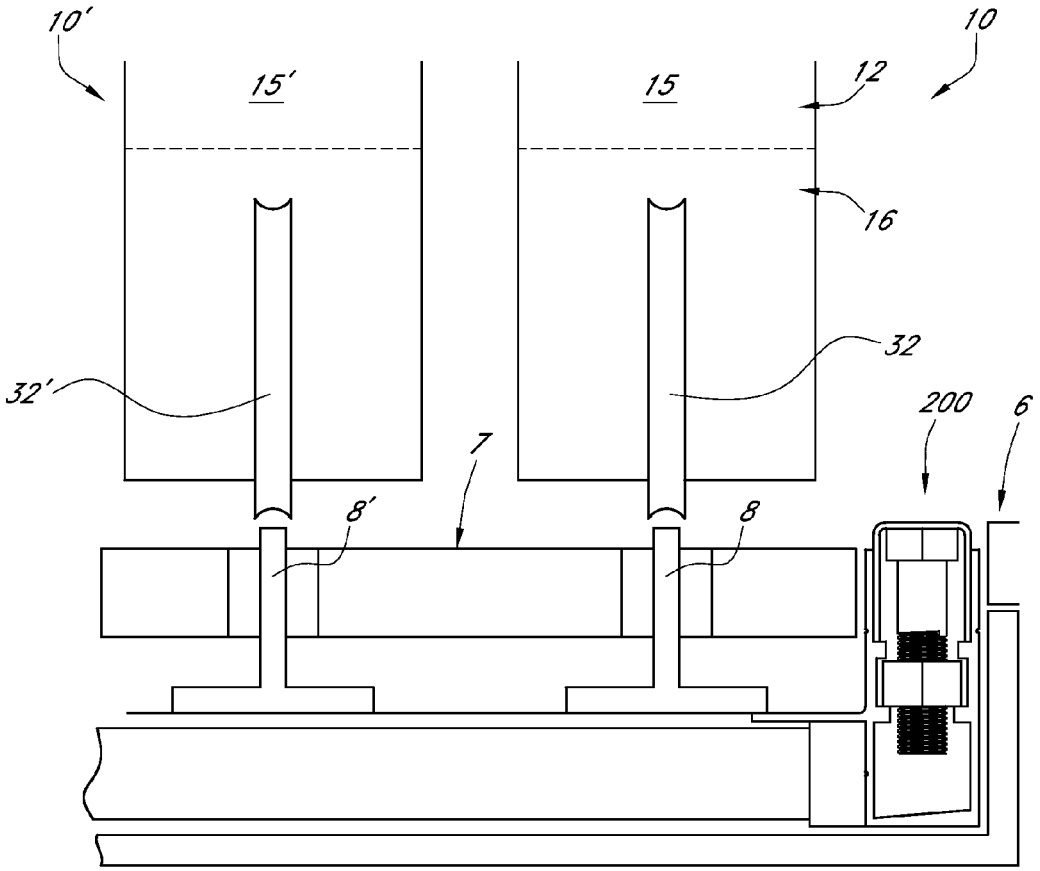
FIG. 6 is a schematic front partial cross sectional view of a multiple sliding door drainage system according to an embodiment of the present invention.

FIG. 5 illustrates a sliding door configuration drainage system 200 according to an embodiment of the present invention configured to operate with a sliding door. FIG. 6 illustrates a multiple sliding door drainage system 200 according to an embodiment of the present invention whereby the present invention configured to operate with multiple sliding doors. In various embodiments, any number of embodiments of one or more fenestration products 10 can be used to form a sliding door panel system 11. In various embodiments, additional door panels can be denoted with a prime symbol, such as a first door panel 15, a second door panel 15', a third door panel 15", etc. In various embodiments of sliding door systems, two or more sliding door panels 15 can be arranged, typically sliding on parallel tracks, to form a "multislide"

door system that can span an opening. The individual door panels 15 of a multislide door system can include one or more transparent or translucent windowpanes 20 to provide access to a panoramic view or light even when the door system is closed. In some embodiments, some or all of the door panels of multislide systems can be retracted into a pocket of a door jamb in an adjacent wall, such that when the door system is open, an indoor/outdoor building space is created. In one embodiment, the fenestration product 10 is configured to open and close between an interior 120 and an exterior 122. In one embodiment, the interior 120 is the inside of a building, house, room, or structure. In one embodiment, the exterior 122 is the outside of a building, house, room, or structure. In various embodiments, although the term interior 120 or exterior 122 is used, the names are being used in reference to a side of embodiments of the fenestration product 10 and can simply refer to a side of a wall or side of the fenestration product 10 whether one side is in or out of a structure or wall. In various embodiments the interior 120 and/or exterior 122 can be any combination of inside, outside, both inside or both outside of a structure, wall, etc. In various embodiments, a door panel 15 can comprise vertical stiles 12, 14 and horizontal rails 16, 18. The stiles and rails can comprise a rigid material such as a wood, metal, plastic or polymer, composite, or other suitable material construction. In some embodiments, the stiles 12, 14 and the rails 16, 18 comprise a hardwood. In some embodiments, the stiles 12, 14 and the rails 16, 18 comprise aluminum. In some embodiments, the stiles 12, 14 and the rails 16, 18 comprise a wood reinforced with at least a metallic strip. Where the stiles 12, 14 and the rails 16, 18 are comprised of a metal, in some embodiments, they can be formed by extrusion. In various embodiments, any combination of materials can be used.

In one embodiment, a sliding door panel system 11 includes one, two or more door panels 15, 15' slideably disposed on one or more lower tracks 8, 8'. In one embodiment, each door panel 15 is slideably disposed on a track segment 8. It is contemplated that multiple door panels 15, 15' can be arranged (for example, including two, three, four, five, six, or more door panels 15) to form various sliding door systems. The sliding door panel system 11 can be configured to be slideably mounted to a jamb or door frame 1 having a header 2 and an upper track 4 (not illustrated here). In one embodiment, the door panels 15 can run on parallel tracks 4, 4', 8, 8'. In one embodiment, one or more door panels 15 can be stored in a pocket 3 (not illustrated here) to the side of the door frame 1 or an upper track 4 (not illustrated here) or a lower track 8. For example, in some embodiments, the door panel 15 can include one or more upper roller mechanisms 30 configured to ride in the upper track 4 to guide the door panel 15 along the upper track 4 (not illustrated). In one embodiment, the door panel 15 has adjustable rollers. In one embodiment, the door panel 15 has weather stripping. In one embodiment, both adjustable rollers and weather stripping are used together, and as the rollers are adjusted the weather stripping may or may not come into contact with the threshold or the ground.

In one embodiment, the door panel 15 can be configured to be slideably disposed on a lower track 8. In various embodiments, the lower track 8 can be recessed below a floor surface 6, even with a floor surface 6, or raised above a floor surface 6. In the one embodiment, the door panel 15 can further be configured to be slideably disposed on a lower track 8 recessed into a floor surface 6. For example, in some embodiments, the door panel 15 can include one or more lower roller mechanisms 32 configured to ride on the lower track 8. In some embodiments, the door panel 15 can be configured to run on a lower track 8 that is not recessed.

In several embodiments, the drainage systems described herein are particularly suitable for the sliding doors described in PCT/US2009/047540, filed on Jun. 16, 2009. This application incorporates the disclosure of U.S. application Ser. No. 12/999,433, filed Dec. 16, 2010 as a national phase application from PCT/US2009/047540 filed in English on Jun. 16, 2009, which claims the benefit of priority to U.S. Provisional Application No. 61/073,320, filed Jun. 17, 2008, and which is incorporated by reference in its entirety herein. In several embodiments, the drainage systems described herein are particularly suitable for the sliding doors described in PCT/US2008/050928, filed on Jan. 11, 2008. This application incorporates the disclosure of U.S. application Ser. No. 12/522,909, filed Jul. 10, 2009 as a national phase application from PCT/US2008/050928 filed in English on Jan. 11, 2008, which claims the benefit of priority to U.S. Provisional Application No. 60/880,255, filed Jan. 12, 2007, and which is incorporated by reference in its entirety herein.

Figure 7:
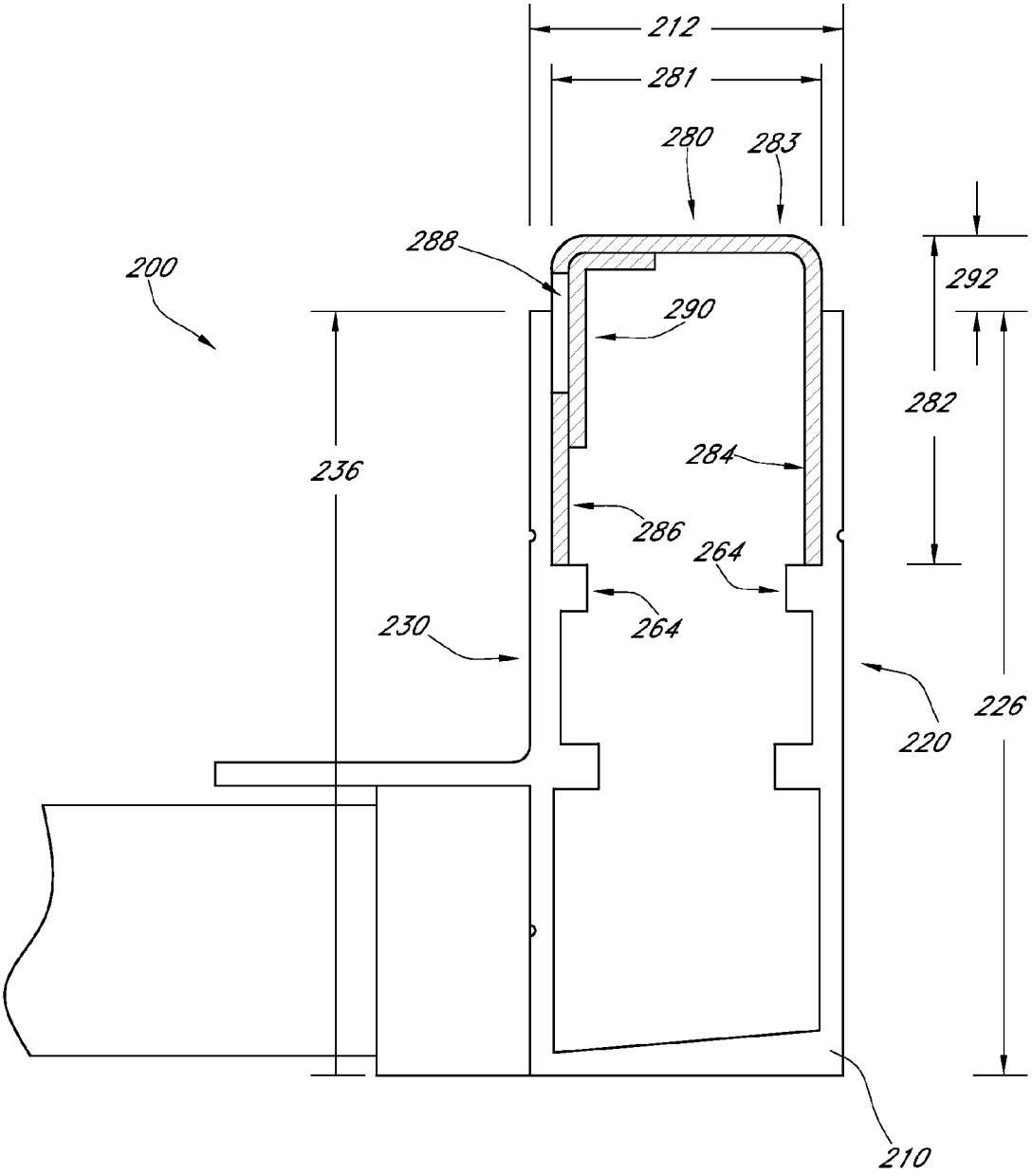
FIG. 7 is a schematic front partial cross sectional view of a drainage system according to an embodiment of the present invention.

FIG. 7 illustrates a drainage system 200 according to an embodiment of the present invention in accord with the embodiments of a drainage system 200 disclosed herein with respect to FIGS. 1-6. As illustrated in FIG. 7, the embodiment is shown at a location in which an adjustable member 260 is not visible. In one embodiment, a drainage system 200 is configured to fit within or between the interior jamb line of a wall and the fenestration product 10. In one embodiment, an adjustable height cover 280 is configured with a cover width 281 that is less than the body width 212 to fit inside or between the walls 220, 230 of the body 210. In one embodiment, not illustrated here, an adjustable height cover 280 is configured with a cover width 281 that is greater than the body width 212 to fit over and around the body 210. In various embodiments, the cover width 281 is less than 1 inch, 0.125 inches, 0.1875, 0.25 inches, 0.375 inches, 0.5 inches, 0.625 inches, 0.75 inches, 0.875 inches, 1.0 inches, 1.25 inches, 1.5 inches, 2 inches, or any dimension or range of dimensions between 0.125 inches and 1 foot or more. In various embodiments, the body width 212 is less than 1 inch, 0.125 inches, 0.1875, 0.25 inches, 0.375 inches, 0.5 inches, 0.625 inches, 0.75 inches, 0.875 inches, 1.0 inches, 1.25 inches, 1.5 inches, 2 inches, or any dimension or range of dimensions between 0.125 inches and 1 foot or more.

Figure 8:
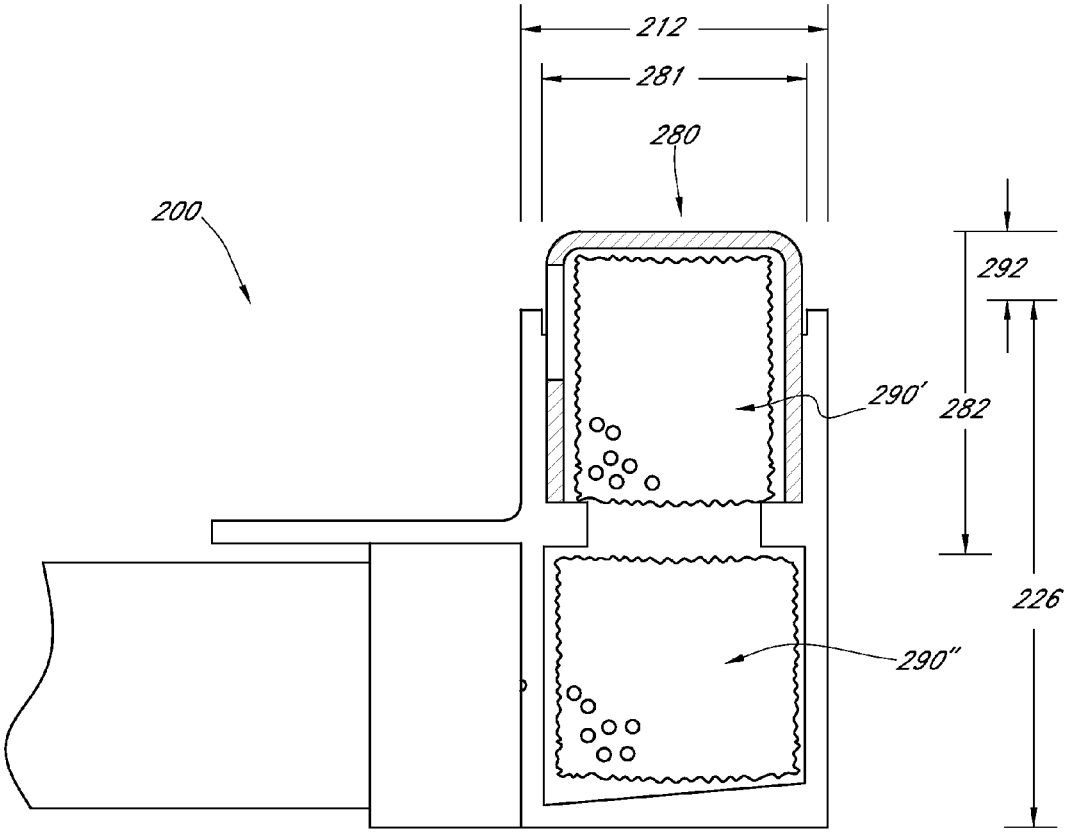
FIG. 8 is a schematic front partial cross sectional view of a compact height configuration of a drainage system according to an embodiment of the present invention.

In various embodiments, the cover-to-body-wall height 292 is configured to be controllably adjustable or variable. As illustrated in FIGS. 7 and 8, the first wall height 226, second wall height 236, cover height 282, and cover-to-body-wall height 292 can be varied or produced in various fixed dimensions to meet any of the various configurations shown at least in FIGS. 2-6 or other configurations. FIG. 8 illustrates a compact height configuration of a drainage system 200 according to an embodiment of the present invention, wherein the body 210 is relatively shorter than the body 210 shown in the embodiment illustrated at FIG. 7.

In optional embodiments, a cover 280 can comprise a filter 290, 290', 290". In various embodiments, the filter 290 is a mesh, screen, matrix, fabric, sponge, porous medium or other material configured to fit outside, inside or within one or more apertures 288. In various embodiments, the filter 290 is configured to prevent the passage of insects or debris from clogging the drainage system 200. In one embodiment, the filter 290 is configured to be removable for cleaning or replacement from the drainage system 200. In one embodiment, the filter 290 is roughly two-dimensional structure configured to extend across one or more or all apertures 288. In one embodiment, the filter 290 is three-dimensional structure configured to fit within the cover 280. In one embodiment, the filter 290 is three-dimensional structure configured to fit within the channel 215 of a body 210. In one embodiment, the filter 290 is configured to be readily accessible for servicing without removing or disassembling the fenestration product 10.

Figure 9:
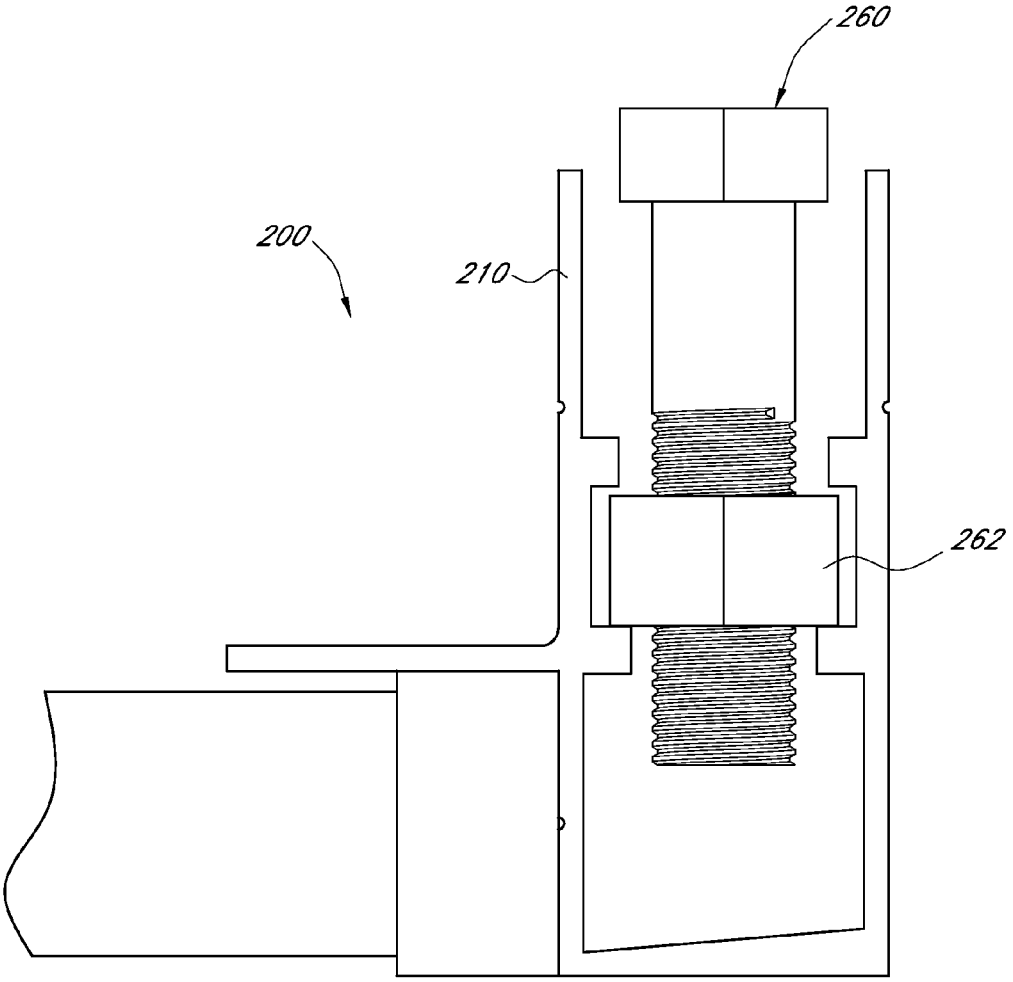
FIG. 9 is a schematic front partial cross sectional view of the drainage system according to FIG. 7 with an adjustable height cover removed.
Figure 10:
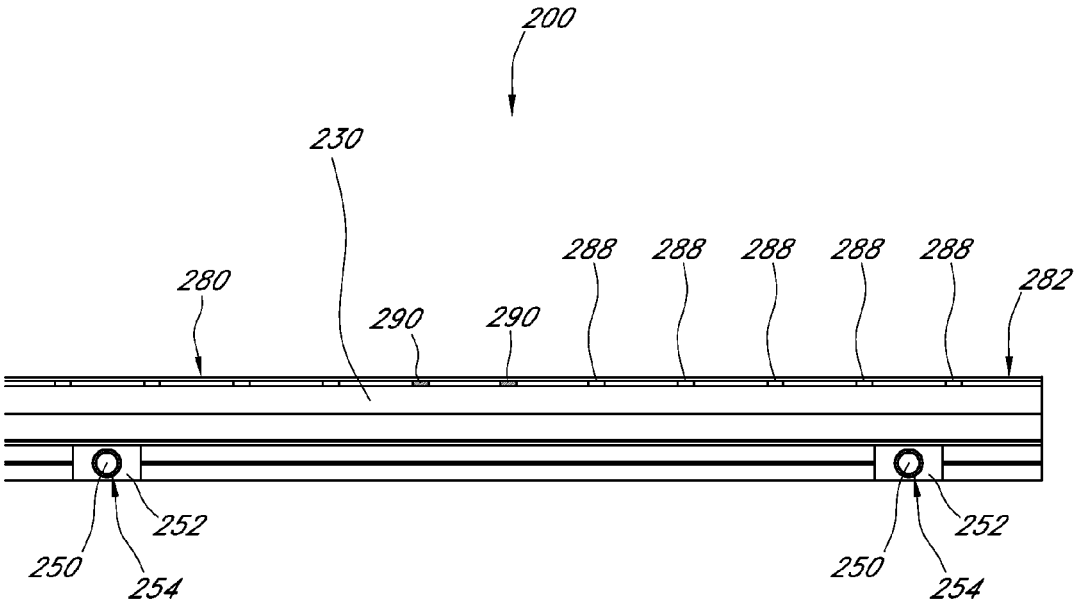
FIG. 10 is a schematic side view of the drainage system according to FIG. 7.

FIG. 9 illustrates the drainage system 200 according to FIG. 7 with an adjustable height cover 280 removed. In various embodiments, the adjustable height cover 280 can be configured to be disposable and maneuverable or adjustable with one, two or more adjustable members 260. In one embodiment, a single adjustable member 260 is configured to adjust the height of the adjustable height cover 280. In one embodiment, a two, three, four, or more adjustable members 260 are distributed along a length or a cover 280 are configured to adjust the height of the adjustable height cover 280. In one embodiment, a first end adjustable member 260 and second end adjustable member 260 are configured to adjust the height, tilt, slant, slope, and/or position of the adjustable height cover 280. In various embodiments, two or more adjustment members 260 can be distributed evenly or asymmetrically at any distance apart. In various embodiments, the distance between adjustment members 260 can vary depending on the length of the cover 280, the body length 213, interior floor surface 6 considerations, exterior floor surface 7 considerations, or other distances, including, but not limited to 6 inches, 12 inches, 18 inches, 24 inches, or anywhere in the range of 1 inch to six feet. In one embodiment, any adjustment member 260 can be set to the same or different height as adjacent or other adjustment members 260 in an attempt to flatten, tilt, slant, and/or configure a position of a cover 280. FIGS. 10-16 illustrate the drainage system 200 according to FIG. 7 either with or without an adjustable height cover 280 shown.

It will be understood by those of skill in the art that numerous and various modifications can be made without departing from the spirit of the present invention. Therefore, it should be clearly understood that the forms of the present invention are illustrative only and are not intended to limit the scope of the present invention. Although a few embodiments have been described in detail above, other modifications are possible. For example, although several of the embodiments described herein discuss drainage systems used with linear movement of door panels along tracks that can be parallel or linear, it is also contemplated that drainage systems can be used with door panels, track, and related movement can be accomplished with rounded doors and or tracks, curves and/or arcs, or other shapes as well. Other embodiments may be within the scope of the following claims. It will be understood that the foregoing is only illustrative of the principles of the invention, and that various modifications, alterations, and combinations can be made by those skilled in the art without departing from the scope and spirit of the invention. Accordingly, it is not intended that the invention be limited, except as by the appended claims.

What is claimed is:

1. A door drainage system, comprising:

a base comprising a channel configured for redirecting a liquid away from a door;

an adjustable height cover removably positionable on the base, the adjustable height cover comprising a first vertical wall facing an exterior side direction, wherein the first vertical wall comprises a plurality of apertures configured to redirect flow of a liquid from the exterior side direction through the drainage system;

an adjustable member base connected to the base, the adjustable member base being linearly positionable along a longitudinal axis of the adjustable member base;

two or more adjustable members configured to controllably position the adjustable height cover to be flush with, higher than, or recessed below an adjacent structural surface; and one or more exit ports in the base in fluid connection with one or more drainage ports configured to direct the liquid away from the base, wherein the adjustable height cover is configured to be readily removable from the base for service without adjusting, removing or disassembling the adjustable members.

2. The door drainage system of claim 1, wherein at least one adjustable member comprises an elongate threaded member configured for controlled vertical positioning of the adjustable height cover.

3. The door drainage system of claim 1, further comprising a filter configured to fit in said channel.

4. The door drainage system of claim 1, further comprising a valve for adjustable fluid control.

5. A door drainage system, comprising:

a body comprising a channel configured for redirecting a liquid away from a door;

an adjustable height cover removably positionable on the body, wherein the adjustable height cover comprises a cover top surface, a cover first vertical wall facing an exterior side direction, and a cover second vertical wall facing an interior side direction, wherein the cover first vertical wall comprises a plurality of apertures configured to redirect flow of a liquid from the exterior side direction through the drainage system; and two or more adjustable members configured to controllably position the adjustable height cover, wherein the adjustable height cover is configured to be readily removable from the body for service without removing or disassembling the door, wherein the adjustable height cover is configured to be readily removable from the body for service without adjusting the adjustable members.

6. The door drainage system of claim 5, further comprising an adjustable member base connected to the body, the two or more adjustable members being linearly positionable with respect to the adjustable member base.

7. The door drainage system of claim 5, wherein the two or more adjustable members are configured to controllably position the adjustable height cover to be flush with, higher than, or recessed below an adjacent structural surface.

8. The door drainage system of claim 5, wherein at least one adjustable member comprises an elongate threaded member configured for controlled vertical positioning of the adjustable height cover.

9. The door drainage system of claim 5, wherein the adjustable height cover comprises a plurality of apertures configured to redirect flow of a liquid through the drainage system.

10. The door drainage system of claim 5, wherein the body includes a first wall, a second wall and a base at least partially surrounding said channel.

11. The door drainage system of claim 5, wherein the body comprises a U-shaped extrusion.

12. The door drainage system of claim 5, further comprising a filter configured to fit in said channel.

13. The door drainage system of claim 5, further comprising one or more exit ports in the body in fluid connection with one or more drainage ports configured to direct the liquid away from the body.

14. The door drainage system of claim 5, further comprising a valve for adjustable fluid control.

15. The door drainage system of claim 14, wherein the valve is disposed on one or more drainage ports.

16. The door drainage system of claim 5, further comprising one or more sliding doors disposed on a track disposed in an exterior position with respect to the body.

17. A fenestration product drainage system, comprising:

a base comprising a channel configured for redirecting a liquid away from a fenestration product;

an adjustable height cover removably positionable on the base, wherein the adjustable height cover comprises a first vertical wall facing an exterior side direction, wherein the first vertical wall comprises a plurality of apertures configured to redirect flow of a liquid from the exterior direction through the drainage system; and an adjustable member configured to controllably position the adjustable height cover, wherein the adjustable height cover is configured to be readily removable from the base for service without adjusting, removing or disassembling the fenestration product.

18. The fenestration product drainage system of claim 17, wherein the adjustable member comprises an elongate threaded member configured for controlled vertical positioning of the adjustable height cover.

19. The fenestration product drainage system of claim 17, further comprising one or more exit ports in the base in fluid connection with one or more drainage ports configured to direct the liquid away from the base.

20. The fenestration product drainage system of claim 17, further comprising a valve for adjustable fluid control.

* * * * *